US011889908B1

(12) United States Patent
Xie

(10) Patent No.: US 11,889,908 B1
(45) Date of Patent: Feb. 6, 2024

(54) NAIL CLIPPER

(71) Applicant: Qunhuang Xie, Putian (CN)

(72) Inventor: Qunhuang Xie, Putian (CN)

( * ) Notice: Subject to any disclaimer, the term of this patent is extended or adjusted under 35 U.S.C. 154(b) by 0 days.

(21) Appl. No.: 18/365,466

(22) Filed: Aug. 4, 2023

(51) Int. Cl.
*A45D 29/00* (2006.01)
*A45D 29/02* (2006.01)

(52) U.S. Cl.
CPC ..... *A45D 29/023* (2013.01)

(58) Field of Classification Search
CPC ..... A45D 29/023
USPC ..... 30/28, 124, 125
See application file for complete search history.

(56) References Cited

U.S. PATENT DOCUMENTS 860,975 A * 7/1907 Havell ..... A45D 29/02 30/28
4,130,937 A * 12/1978 Kim ..... A45D 29/023 30/28
4,380,120 A * 4/1983 Hannon ..... A45D 29/023 30/28
4,614,031 A * 9/1986 Chen ..... A45D 29/023 30/28
5,072,511 A * 12/1991 Ro ..... A45D 29/023 30/28
5,537,747 A * 7/1996 Cacciotti ..... A45D 29/023 30/28
5,564,189 A * 10/1996 Lee ..... A45D 29/023 30/28

* cited by examiner

*Primary Examiner* — Hwei-Siu C Payer
(74) *Attorney, Agent, or Firm* — Daniel M. Cohn; Howard M. Cohn

(57) ABSTRACT

A nail clipper includes a first main body, a second main body, a pressing plate, and a cover plate. The first main body includes a first clipper head, a first clipper body, a first baffle plate, and a second baffle plate. The first clipper head is fixedly connected to a first end of the first clipper body, the first baffle plate is disposed at a first side of the first clipper body, the second baffle plate is disposed at a second side of the first clipper body. A through hole is defined on the first clipper body, and the through hole is located between the first baffle plate and the second baffle plate. The second main body includes a second clipper head and a second clipper body.

17 Claims, 6 Drawing Sheets

NAIL CLIPPER

TECHNICAL FIELD

The present disclosure relates to a technical field of personal care products, and in particular to a nail clipper.

BACKGROUND

Nail clippers are also referred to as nail scissors and nail cutters and are one kind of personal care products, and the nail clippers are mainly configured to trim fingernails and toenails. Most of the nail clippers are made of metal, and are operated with a lever principle at the same time. A user only needs to apply force to press a tail end of a nail clipper to easily cut off fingernails through a sharp clipper head of the nail clipper.

In the prior art, the nail clipper includes a main body and a pressing plate, the main body and the pressing plate are connected through a rotating component, and the pressing plate is capable of driving the main body under an action of an external force, thereby changing a gap defined between a clipper head of the nail clipper to achieve a function of trimming the fingernails and the toenails. In actual application, fingernail clippings and toenail clippings are easy to scatter everywhere during a process of trimming the fingernails and the toenails and are not easy to remove, and the fingernail clippings and the toenail clippings may even fly around.

In order to solve the problem of flying the fingernail clippings and the toenail clippings around, a sliding sleeve is sleeved on the main body of the nail clipper, the sliding sleeve defines an accommodating space, and the sliding sleeve may be sleeved on the main body of the nail clipper or taken down from the main body of the nail clipper in a sliding manner. In actual application, the sliding sleeve needs to be sleeved on the main body of the nail clipper before trimming the fingernails and the toenails. After trimming the fingernails and the toenails, the sliding sleeve needs to be taken down for removing the fingernail clippings and the toenail clippings. That is, every time the nail clipper is used, the sliding sleeve and the main body need to be assembled at least one time, and disassembled at least one time, assembling and disassembling the sliding sleeve and the main body for a long time or too many times and continuously rubbing the main body may easily scratch the main body of the nail clipper.

SUMMARY

Embodiments of the present disclosure provide a nail clipper capable of solving a problem that a sliding sleeve may scratch a main body of a nail clipper.

The embodiment of the present disclosure provides a nail clipper, including a first main body, a second main body, a pressing plate, and a cover plate. The first main body includes a first clipper head, a first clipper body, a first baffle plate, and a second baffle plate. The first clipper head is fixedly connected to a first end of the first clipper body, the first baffle plate is disposed at a first side of the first clipper body, the second baffle plate is disposed at a second side of the first clipper body. A through hole is defined on the first clipper body, and the through hole is located between the first baffle plate and the second baffle plate.

The second main body includes a second clipper head and a second clipper body, the second clipper head is fixedly connected to a first end of the second clipper body, a second end of the second clipper body is fixedly connected to a second end of the first clipper body. The second clipper head is disposed opposite to the first clipper head. The first baffle plate, the second baffle plate, the first clipper body, and the second clipper body form an accommodating cavity.

A first end of the pressing plate is connected to the first end of the second clipper body through a first rotating component, the pressing plate is capable of rotating with respect to the second clipper body around the first rotating component.

The cover plate is connected to the first clipper body through a second rotating component, the cover plate is capable of rotating with respect to the first clipper body around the second rotating component, so as to cover the through hole or not cover the through hole.

When the through hole is covered by the cover plate, the pressing plate is capable of driving the cover plate to drive the first clipper body to deform, so as to shorten or increase a distance between the second clipper head and the first clipper head.

When the through hole is not covered by the cover plate, the cover plate is located between the pressing plate and the first clipper body, and a second end of the pressing plate is capable of being attached to the first clipper body.

In one embodiment, the pressing plate includes a plate body and a driving component, the driving component is disposed on a surface of the plate body.

When the through hole is covered by the cover plate, the driving component is capable of abutting against the cover plate, the plate body is driven by an external force to drive the first clipper body to deform through the driving component and the cover plate, as so to shorten or increase the distance between the second clipper head and the first clipper head.

When the through hole is not covered by the cover plate, at least a part of the driving component is capable of being placed in the through hole, or the at least the part of the driving component is capable of being placed in the through hole and the accommodating cavity.

In one embodiment, the through hole includes a first through hole and a second through hole, the first through hole is communicated with the second through hole. Both the first through hole and the second through hole are communicated with the accommodating cavity. The first through hole is closer to the first clipper head than the second through hole, and the cover plate is capable of covering the first through hole and the second through hole.

When the through hole is not covered by the cover plate, the at least the part of the driving component is capable of being placed in the first through hole, or the at least the part of the driving component is capable of being placed in the first through hole and the accommodating cavity.

In one embodiment, an area of the first through hole is smaller than an area of the second through hole.

In one embodiment, a length of the first through hole in a width direction of the first clipper body is smaller than a length of the second through hole in the width direction of the first clipper body.

In one embodiment, a reinforcing plate is disposed at a periphery of the cover plate, when the through hole is covered by the cover plate, the reinforcing plate is disposed at one side or two sides of the first through hole.

In one embodiment, the reinforcing plate includes a first reinforcing plate and a second reinforcing plate. The first reinforcing plate protrudes from the first side of the first clipper body, and the second reinforcing plate protrudes from the second side of the first clipper body.

In one embodiment, one surface of the driving component capable of abutting against the cover plate is an arc-shaped surface.

In one embodiment, the plate body includes a reinforcing structure, and the reinforcing structure and the driving component are located on two opposite surfaces of the plate body.

In one embodiment, the second rotating component is disposed at two sides of the cover plate, the first clipper body includes a first protrusion block and a second protrusion block, a first connecting hole is defined on the first protrusion block, a second connecting hole is defined on the second protrusion block, and the second rotating component passes through the first connecting hole and the second connecting hole.

In one embodiment, the second main body further includes a first connecting component and a second connecting component. The first connecting component is disposed at a first side of the second clipper body, the second connecting component is disposed at a second side of the second clipper body, and the first connecting component and the second connecting component are oppositely disposed at the first end of the second clipper body.

The first connecting component and the second connecting component are jointly connected to the first end of the pressing plate through the first rotating component.

The first clipper body is capable of being located between the second clipper body and the pressing plate, and a part of the first clipper body is limited between the second clipper body, the first connecting component, the second connecting component, and the pressing plate.

In one embodiment, a first shaft hole is defined on the first connecting component, a second shaft hole is defined on the second connecting component.

A third shaft hole is defined at the first end of the pressing plate, the first rotating component passes through the first shaft hole, the third shaft hole, and the second shaft hole.

In one embodiment, a first notch is formed between the first baffle plate and the first clipper head, and a second notch is formed between the second baffle plate and the first clipper head.

The first notch accommodates the first connecting component, and the first connecting component is capable of moving in the first notch.

The second notch accommodates the second connecting component, and the second connecting component is capable of moving in the second notch.

In one embodiment, the nail clipper further includes a fastening assembly, the fastening assembly is fixedly connected to the second end of the first clipper body and the second end of the second clipper body.

The fastener assembly includes a fastening plate and a fastener. A first fastening hole is defined on the first clipper body, a second fastening hole is defined on the second clipper body, and a third fastening hole is defined on the fastening plate. The fastener passes through the first fastening hole, the second fastening hole, and the third fastening hole.

In one embodiment, an accommodating groove is defined on the fastening plate, both the second end of the first clipper body and the second end of the second clipper body are disposed in the accommodating groove, and the accommodating groove is respectively communicated with the first fastening hole and the second fastening hole.

In one embodiment, the nail clipper further includes a blocking component, the blocking component is disposed between the first baffle plate and the second baffle plate, and is limited in the accommodating cavity, so as to prevent clippings accommodated in the accommodating cavity from moving toward the second end of the first main body and the second end of the second main body.

In one embodiment, the blocking component includes a blocking portion, a connecting portion, and a limiting portion. The blocking portion, the connecting portion, and the limiting portion are all disposed in the accommodating cavity and are limited by the first baffle plate, the second baffle plate, the second main body, and the cover plate.

A first end of the blocking portion is connected to a first end of the limiting portion through the connecting portion. The blocking portion and the limiting portion are bent with respect to the connecting portion, a second end of the blocking portion is capable of abutting against the second clipper body, and is obliquely disposed with respect to the second clipper body. The second end of the limiting portion is capable of abutting against the second clipper body, and is obliquely disposed with respect to the second clipper body. The limiting portion is disposed close to a first edge of the through hole, and the first edge of the through hole is away from the first clipper head.

When the limiting portion is subjected to an extrusion force, a surface of the limiting portion is capable of abutting against the first edge of the through hole to limit the connecting portion and the blocking portion to limit excessive movement of the connecting portion and the blocking portion toward the second end of the first main body and the second end of the second main body.

The present disclosure further provides a nail clipper, including a main body, a pressing plate, and a cover plate. The main body includes an accommodating cavity and a through hole, and the through hole is communicated with the accommodating cavity. A first end of the pressing plate is connected to the main body, and the pressing plate is capable of rotating with respect to the main body. The cover plate is connected to the main body, and the cover plate is capable of rotating with respect the main body so as to cover the through hole or not cover the through hole. When the through hole is covered by the cover plate, the pressing plate is capable of driving the cover plate to drive the main body, and when the through hole is not covered by the cover plate, the cover plate is located between the pressing plate and the main body, and a second end of the pressing plate is capable of being attached to the first clipper body.

In one embodiment, the pressing plate includes a plate body and a driving component, the driving component is disposed on a surface of the plate body.

When the through hole is covered by the cover plate, the driving component is capable of abutting against the cover plate, the plate body is driven by an external force to drive the main body through the driving component and the cover plate.

When the through hole is not covered by the cover plate, at least a part of the driving component is capable of being placed in the through hole, or the at least the part of the driving component is capable of being placed in the through hole and the accommodating cavity.

In one embodiment, the through hole includes a first through hole and a second through hole, the first through hole is communicated with the second through hole. Both the first through hole and the second through hole are communicated with the accommodating cavity. The first through hole is closer to a clipper head of the main body than the second through hole, and the cover plate is capable of covering the first through hole and the second through hole.

When the through hole is not covered by the cover plate, the at least the part of the driving component is capable of being placed in the first through hole, or the at least the part of the driving component is capable of being placed in the first through hole and the accommodating cavity.

A length of the first through hole in a width direction of the first clipper body is smaller than a length of the second through hole in the width direction of the first clipper body.

In one embodiment, a reinforcing plate is disposed at a periphery of the cover plate, when the through hole is covered by the cover plate, the reinforcing plate is disposed at one side or two sides of the first through hole.

One surface of the driving component capable of abutting against the cover plate is an arc-shaped surface, the plate body includes a reinforcing structure, and the reinforcing structure and the driving component are located on two opposite surfaces of the plate body.

According to the embodiments of the present disclosure, when the through hole is covered by the cover plate, the pressing plate is capable of driving the cover plate to drive the first clipper body to deform, so as to shorten or increase a distance between the second clipper head and the first clipper head to achieve functions of trimming fingernails or toenails, and fingernail clippings and toenail clippings generated in actual application of the nail clipper may be accommodated in the accommodating cavity; when the through hole is not covered by the cover plate, the cover plate is located between the pressing plate and the first clipper body, and the second end of the pressing plate is capable of being attached to the first clipper body, that is, the pressing plate is in a reset state, and the pressing plate may not drive the first clipper body to deform at this time. Removing the fingernail clippings or the toenail clippings accommodated in the accommodating cavity may be achieved in a situation that the cover plate is opened or the through hole is not covered by the cover plate. Compared with providing a sliding sleeve to accommodate the fingernail clippings or the toenail clippings or remove the fingernail clippings or the toenail clippings in the prior art, the embodiments of the present disclosure provide the cover plate to cover the through hole or not cover the through hole to accommodate the fingernail clippings or the toenail clippings or remove the fingernail clippings or the toenail clippings, which needs not to be sleeved with the main body in a sliding manner and needs not to be disassembled together with the main body, thereby reducing possibility of scratching the main body or even may not scratch the main body.

BRIEF DESCRIPTION OF DRAWINGS

In order to more clearly illustrate technical solutions in embodiments of the present disclosure, accompanying drawings that need to be used in description of the embodiments are briefly described below. Obviously, the accompanying drawings in the following description are merely some embodiments of the present disclosure, and for those who skilled in the art, other drawings may be obtained according to these drawings without involving any inventive effort.

For a more complete understanding of the present disclosure and beneficial effects thereof, the following description is made in conjunction with the accompanying drawings, in which same reference numeral refer to same part in the following description.

DETAIL ED DESCRIPTION

Figure 1:
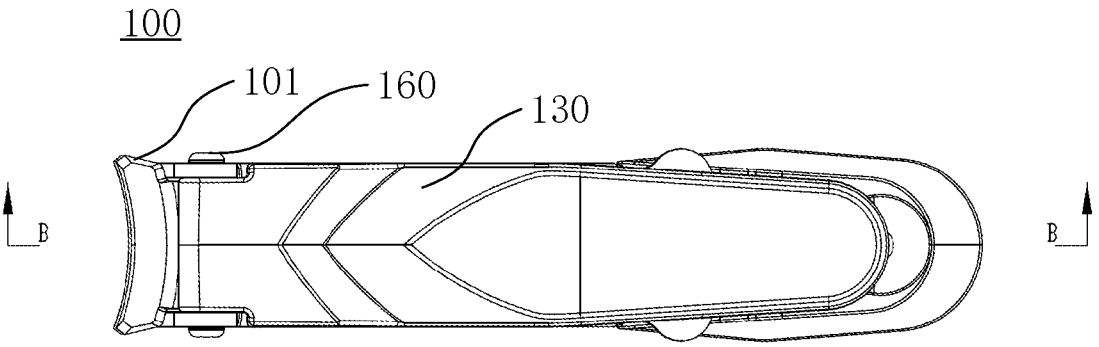
FIG. 1 is an overall structural schematic diagram of a nail clipper according to one embodiment of the present disclosure.

Technical solutions in embodiments of the present disclosure are clearly and completely described below with reference to accompanying drawings in the embodiments of the present disclosure. Obviously, described embodiments are only a part of the embodiments of the present disclosure, but are not all embodiments. All other embodiments obtained by those who skilled in the art based on the embodiments of the present disclosure without creative efforts shall fall within protection scopes of the present disclosure.

Reference herein to "embodiment" or "embodiments" means that a particular feature, structure, or characteristic described in connection with an embodiment or embodiments may be included in at least one embodiment of the present disclosure. Phrases in various positions in the specification are not necessarily all referring to the same embodiment, and are not independent or alternative embodiments mutually exclusive of other embodiments. Those who skilled in the art explicitly and implicitly understand that the embodiments described herein may be combined with other embodiments.

Embodiments of the present disclosure provides a nail clipper, aiming at solving a problem that a main body of a current nail clipper may be scratched due to friction of a sliding sleeve. Meanwhile, research and development personnel of the present disclosure find that in the prior art, the sliding sleeve is sleeved on the main body of the nail clipper, and after the sliding sleeve is sleeved on the main body, an accommodating space of the sliding sleeve is reduced, and actual capability of accommodating fingernail clippings or toenail clippings becomes weak. In some situations, every time the nail clipper having the sliding sleeve is used, the sliding sleeve needs to be detached and mounted twice or more times to remove the fingernail clippings or the toenail clippings, which not only easily causes excessive friction to the main body of the nail clipper to scratch the main body of the nail clipper, but also has insufficient accommodating space, thereby resulting in complex user operation and poor user experience.

In addition, in the prior art, the nail clipper having the sliding sleeve generally needs to rotate a pressing plate for pressing operation in a first direction when the pressing plate changes between a reset position and an operation position, and the first direction may be understood as a direction different from a clamping direction of a clipper head of the nail clipper. Therefore, excessive friction is easily generated between the pressing plate of the nail clipper and the main body of the nail clipper, and clamping capability of the nail clipper gradually become poor.

Based on the problem existing in nail clippers in the prior art. The nail clipper provided in the embodiments of the present disclosure not only solves the problem that the main body of the current nail clipper may be scratched due to the pressing plate and/or friction of the pressing plate, but also may improve accommodating capacity of the fingernail clippings or the toenail clippings to a certain extent. Exemplary drawings are described below in detail with reference to the embodiments of the present disclosure.

The fingernail clippings and the toenail clippings are collectively referred to as clippings. According to the embodiments of the present disclosure, for those who skilled in the art, the nail clipper is mainly configured to trim fingernails or toenails to generate the fingernail clippings or the toenail clippings. It should be understood that the nail clipper provided by the embodiments of the present disclosure is not limited to trimming the fingernails or the toenails, for example, the nail clipper may also be configured to cut other objects, such as lines for sewing clothes, etc. When the nail clipper cut other objects to generate clippings, the fingernail clippings, the toenail clippings, and the clippings are all referred to herein as clippings.

The clipper head may also be referred to as clipper opening, and may include a first clipper head and a second clipper head, and the first clipper head and the second clipper head are oppositely disposed. In an unused state, that is, if the nail clipper is not in use, there is a gap between the first clipper head and the second clipper head, and the gap is configured to accommodate an object, such as a fingernail or a toenail.

Figure 2:
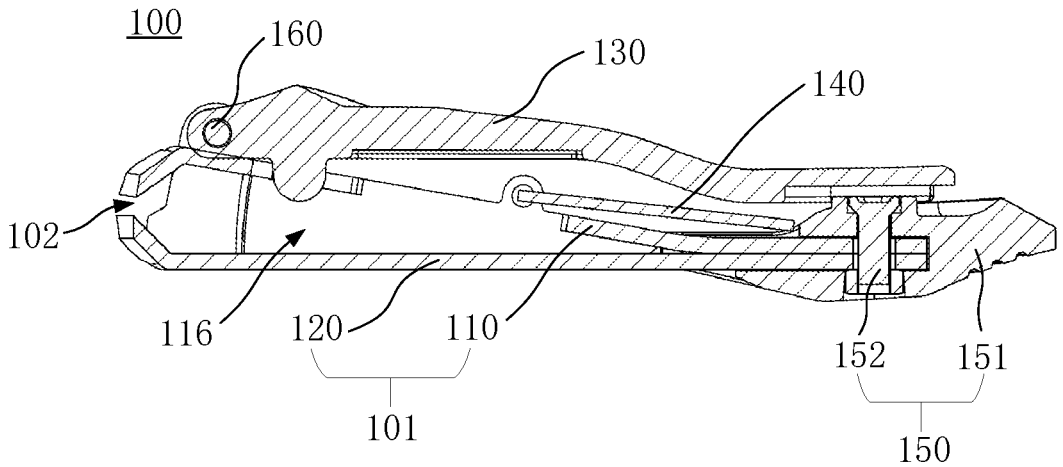
FIG. 2 is a cross-sectional schematic diagram of the nail clipper taken along the line B-B shown in FIG. 1.
Figure 3:
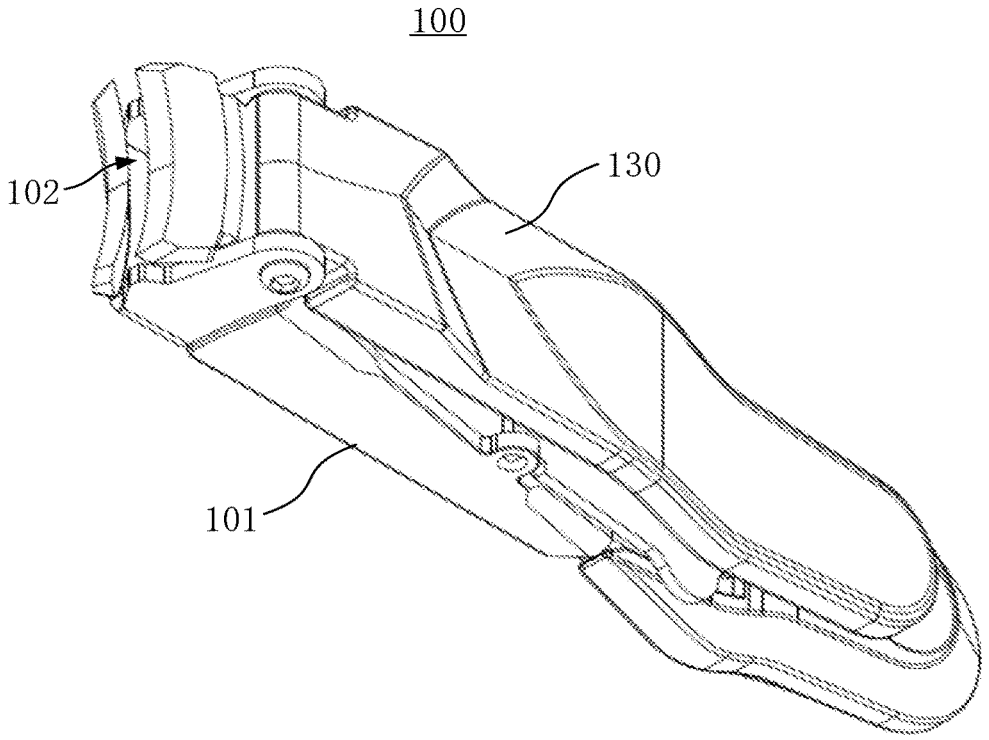
FIG. 3 is a three-dimensional structural schematic diagram of the nail clipper according to one embodiment of the present disclosure.
Figure 4:
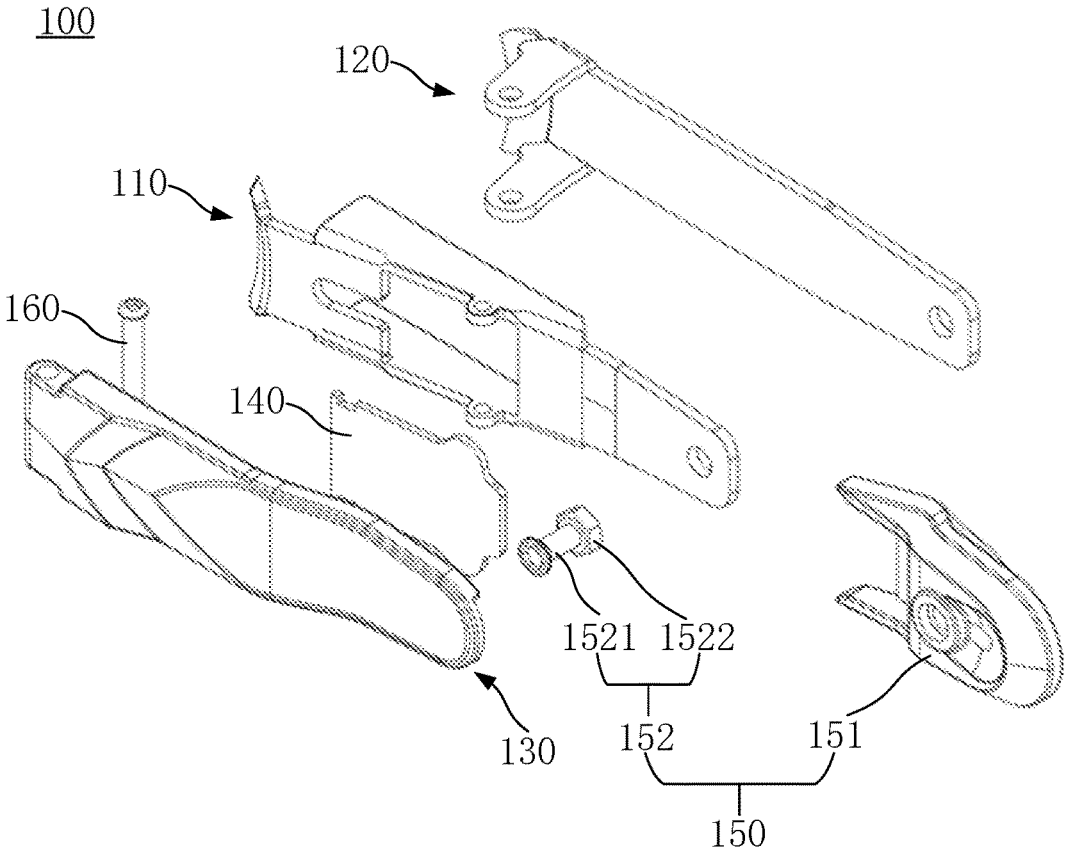
FIG. 4 is an exploded schematic diagram of the nail clipper according to one embodiment of the present disclosure.
Figure 5:
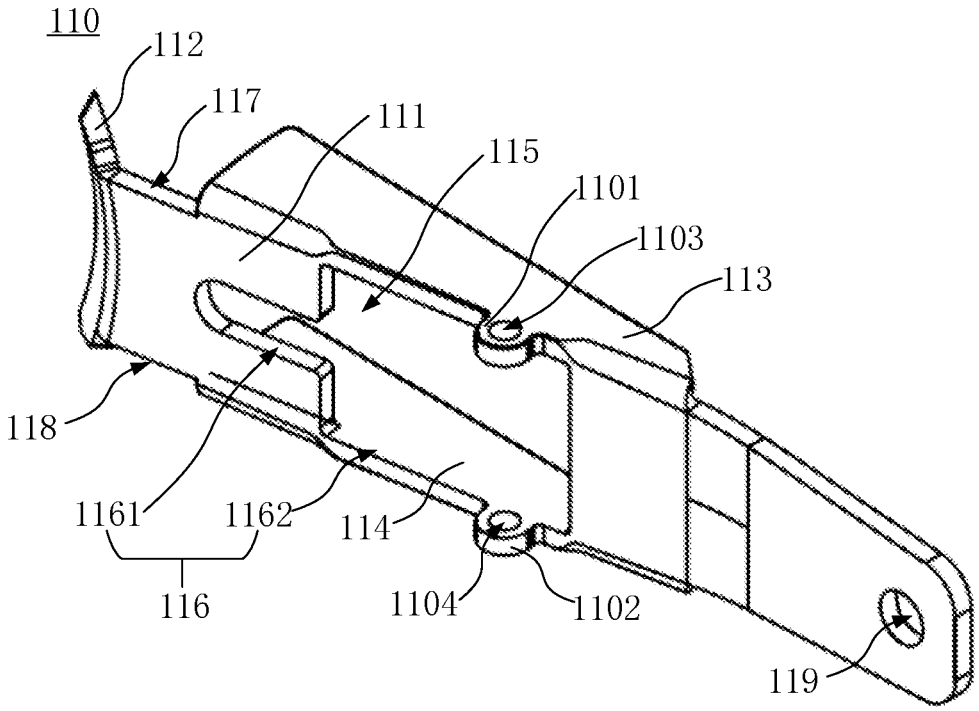
FIG. 5 is a structural schematic diagram of a first main body of the nail clipper according to one embodiment of the present disclosure.
Figure 6:
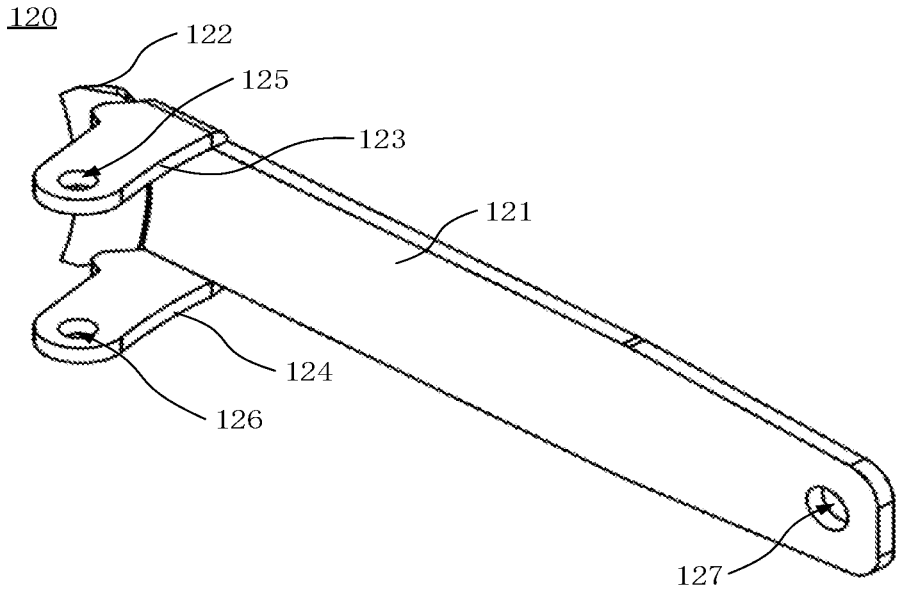
FIG. 6 is a structural schematic diagram of a second main body of the nail clipper according to one embodiment of the present disclosure.
Figure 7:
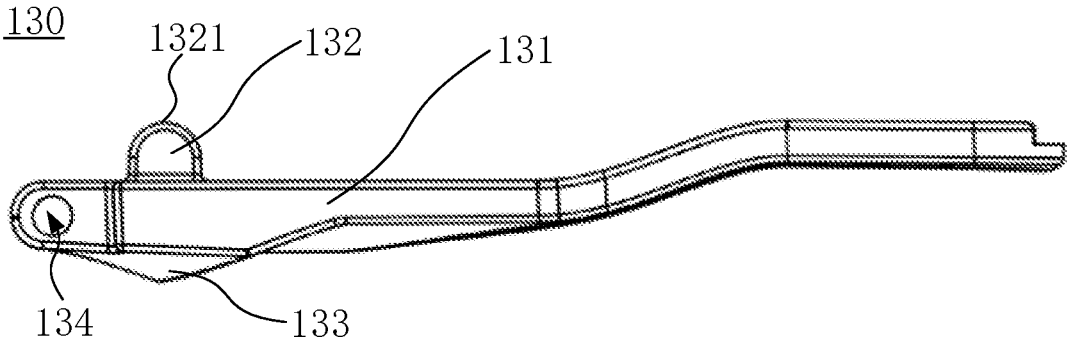
FIG. 7 is a structural schematic diagram of a pressing plate of the nail clipper according to one embodiment of the present disclosure.
Figure 8:
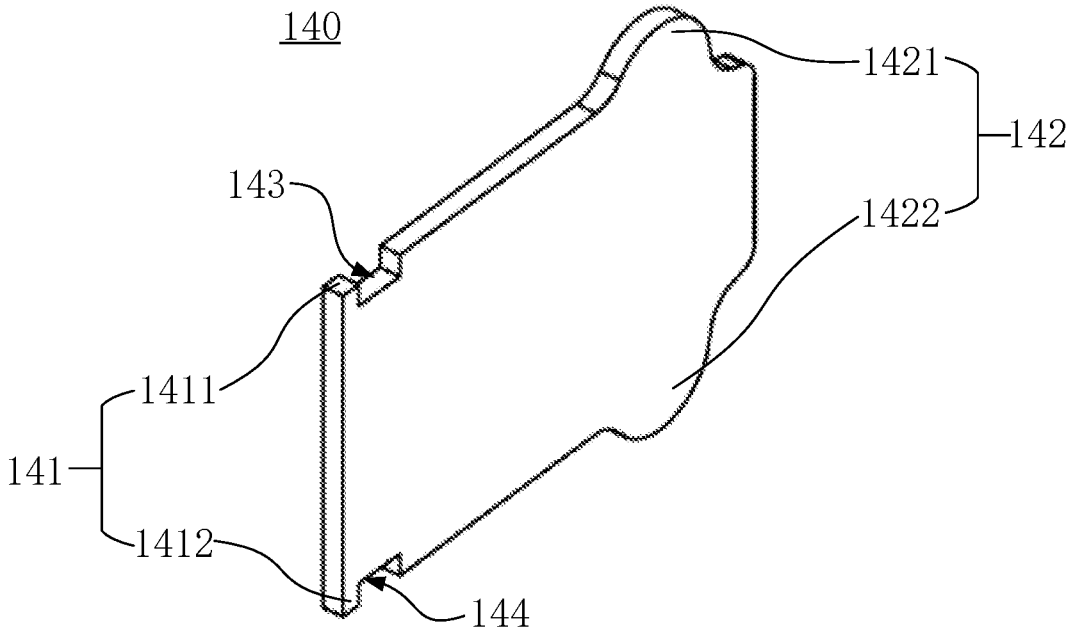
FIG. 8 is a structural schematic diagram of a cover plate of the nail clipper according to one embodiment of the present disclosure.
Figure 9:
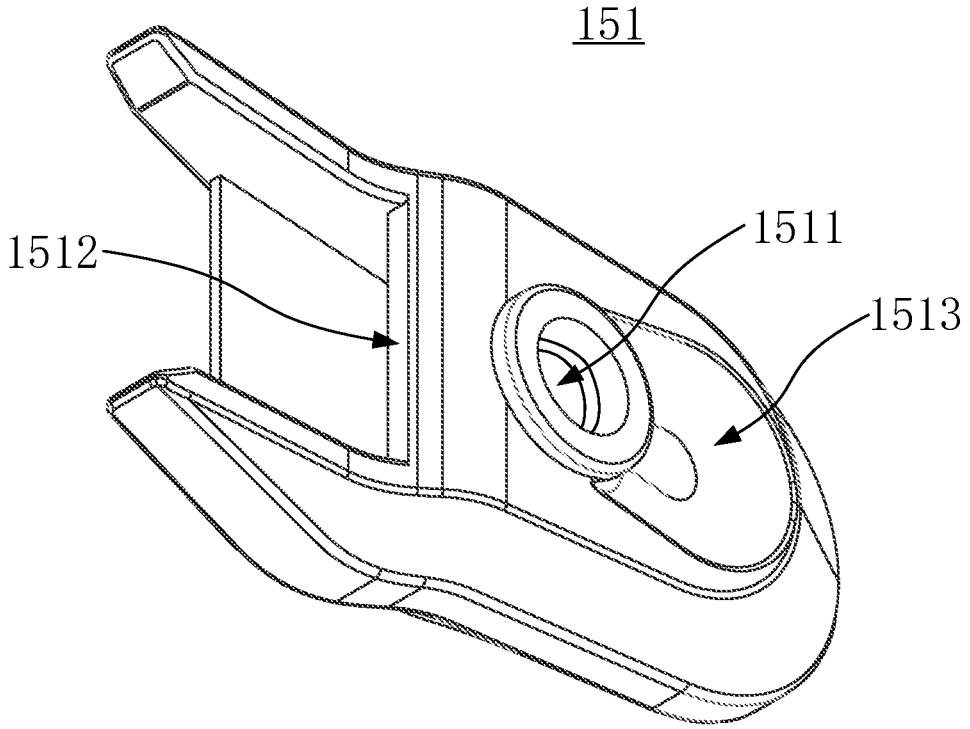
FIG. 9 is a structural schematic diagram of a fastening plate of the nail clipper according to one embodiment of the present disclosure.

Please refer to FIGS. 1-9, FIG. 1 is an overall structural schematic diagram of a nail clipper according to one embodiment of the present disclosure, FIG. 2 is a cross-sectional schematic diagram of the nail clipper taken along the line B-B shown in FIG. 1, FIG. 3 is a three-dimensional structural schematic diagram of the nail clipper according to one embodiment of the present disclosure, FIG. 4 is an exploded schematic diagram of the nail clipper according to one embodiment of the present disclosure, FIG. 5 is a structural schematic diagram of a first main body of the nail clipper according to one embodiment of the present disclosure, FIG. 6 is a structural schematic diagram of a second main body of the nail clipper according to one embodiment of the present disclosure, FIG. 7 is a structural schematic diagram of a pressing plate of the nail clipper according to one embodiment of the present disclosure, FIG. 8 is a structural schematic diagram of a cover plate of the nail clipper according to one embodiment of the present disclosure, and FIG. 9 is a structural schematic diagram of a fastening plate of the nail clipper according to one embodiment of the present disclosure. The nail clipper 100 includes a first main body 110, a second main body 120, a pressing plate 130, and a cover plate 140.

As shown in FIG. 5, the first main body 110 includes a first clipper head 112, a first clipper body 111, a first baffle plate 113, and a second baffle plate 114. The first clipper head 112 is fixedly connected to a first end of the first clipper body 111, the first baffle plate 113 is disposed at a first side of the first clipper body 111, the second baffle plate 114 is disposed at a second side of the first clipper body 111. A through hole 116 is defined on the first clipper body 111, and the through hole 116 is located between the first baffle plate 113 and the second baffle plate 114.

As shown in FIG. 6, the second main body 120 includes a second clipper head 122 and a second clipper body 121, the second clipper head 122 is fixedly connected to a first end of the second clipper body 121, a second end of the second clipper body 121 is fixedly connected to a second end of the first clipper body 111. The second clipper head 122 is disposed opposite to the first clipper head 112. The first baffle plate 113, the second baffle plate 114, the first clipper body 111, and the second clipper body 121 form an accommodating cavity 115.

The second end of the first main body 110 and the second end of the second main body 120 may be directly and fixedly connected to each other, for example, the second end of the first main body 110 is welded with the second end of the second main body 120 in a welding manner. It should be noted that the second end of the first main body 110 and the second end of the second main body 120 may also be fastened through other fastening structures, such as screws. It should be understood that, in other embodiment of the present disclosure, the second end of the first main body 110 and the second end of the second main body 120 may also be fastened through one fastening assembly, such as a plate structure and a fastening structure. It should be noted that fixedly connecting the second end of the first main body 110 with the second end of the second main body 120 may be understood as fixedly connecting the second end of the first clipper body 111 with the second end of the second clipper body 121.

For example, as shown in FIGS. 2, 4, and 9, the nail clipper 100 further includes a fastening assembly 150, the fastening assembly 150 is fixedly connected to the second end of the first clipper body 111 and the second end of the second clipper body 121. The fastener assembly 150 includes a fastening plate 151 and a fastener 152. A first fastening hole 119 is defined on the first clipper body 111, a second fastening hole 127 is defined on the second clipper body 121, and a third fastening hole 1511 is defined on the fastening plate 151. The fastener 152 passes through the first fastening hole 119, the second fastening hole 127, and the third fastening hole 1511. In one embodiment, the fastener 152 may include a screw 1521 and a nut 1522, the screw 1521 passes through the first fastening hole 119, the second fastening hole 127, and the third fastening hole 1511, and a part of the screw 1521 is exposed out of the first fastening hole 119, the second fastening hole 127, and the third fastening hole 1511, and the nut 1522 and the part of the screw 1521 are threadedly connected to fasten the fastening plate 151, the second end of the first clipper body 111, and the second end of the second clipper body 121.

An accommodating groove 1512 is defined on the fastening plate 151, both the second end of the first clipper body 111 and the second end of the second clipper body 121 are disposed in the accommodating groove 1512, and the accommodating groove 1512 is respectively communicated with the first fastening hole 119 and the second fastening hole 127. In the embodiment of the present disclosure, the fastening assembly 150 is configured to enhance connection stability between the second end of the first clipper body 111 and the second of the second clipper body 121.

A concave portion 1513 is defined on the fastening plate 151, the concave portion 1513 is recessed at one side of the third fastening hole 1511 on the fastening plate 1511, and the third fastening hole 151 is located between the concave portion 1513 and the accommodating groove 1512.

The first baffle plate 113 is capable of being located at the first side of the first clipper body 111, and the second baffle plate 114 is capable of being located at the second side of the first clipper body 111. When both the first clipper body 111 and the second clipper body 121 are deformed by an external force, the first baffle plate 113 and the second baffle plate 114 may move along both sides of the second clipper body 121 at the same time. Therefore, when the accommodating cavity 115 accommodates the clippings, and the clippings may be prevented from leaking out.

A first end of the pressing plate 130 is connected to the first end of the second clipper body 121 through a first rotating component 160, the pressing plate 130 is capable of rotating with respect to the second clipper body 121 around the first rotating component 160. It should be noted that, after the pressing plate 130 is connected to the second clipper body 121 through the first rotating component 160, when the pressing plate 130 is subjected to the external force, the pressing plate 130 drives the first clipper body 111 and the second clipper body 121 to deform.

The first rotating shaft 160 may be a structure disposed on the second clipper body 121, or may be a structure disposed on the pressing plate 130.

In one embodiment, the first rotating shaft 160 may be a separate component. For example, as shown in FIG. 6, the second main body 120 further includes a first connecting component 123 and a second connecting component 124. The first connecting component 123 is disposed at a first side of the second clipper body 121, the second connecting component 124 is disposed at a second side of the second clipper body 121, and the first connecting component 123 and the second connecting component 124 are oppositely disposed at the first end of the second clipper body 121. The first connecting component 123 and the second connecting component 124 are jointly connected to the first end of the pressing plate 130 through the first rotating component 160, so that the first clipper body 111 is capable of being located between the second clipper body 121 and the pressing plate 130, and a part of the first clipper body 111 is limited between the second clipper body 121, the first connecting component 123, the second connecting component 124, and the pressing plate 130. A first shaft hole 125 is defined on the first connecting component 123, a second shaft hole 126 is defined on the second connecting component 124, and third shaft hole 134 is defined at the first end of the pressing plate 130. The first rotating component 160 passes through the first shaft hole 125, the third shaft hole 134, and the second shaft hole 126.

A first notch 117 is formed between the first baffle plate 113 and the first clipper head 112, and a second notch 118 is formed between the second baffle plate 114 and the first clipper head 112. The first notch 117 accommodates the first connecting component 123, and the first connecting component 123 is capable of moving in the first notch 117. The second notch 118 accommodates the second connecting component 124, and the second connecting component 124 is capable of moving in the second notch 118.

As shown in FIGS. 1-4 and 8, the cover plate 140 is connected to the first clipper body 111 through a second rotating component 141, the cover plate 140 is capable of rotating with respect to the first clipper body 111 around the second rotating component 141, so as to cover the through hole 116 or not cover the through hole 116. The second rotating component 141 is disposed at two sides of the cover plate 140, the first clipper body 111 includes a first protrusion block 1101 and a second protrusion block 1102, a first connecting hole 1103 is defined on the first protrusion block 1101, a second connecting hole 1104 is defined on the second protrusion block 1102, and the second rotating component 141 passes through the first connecting hole 1103 and the second connecting hole 1104. It should be noted that the first protrusion block 1101 and the first baffle plate 113 are located at the same side of the first clipper body 111, and the second protrusion block 1102 and the second baffle plate 114 are located at the same side of the first clipper body 111. It can be understood that the first protrusion block 1101 and the first baffle plate 113 are jointly located at the first side of the first clipper body 111, and the second protrusion block 1102 and the second baffle plate 114 are jointly located at the second side of the first clipper body 111.

In one embodiment, the second rotating component 141 includes a first rotating portion 1411 and a second rotating portion 1412, the first rotating portion 1411 passes through the first connecting hole 1103, and the second rotating portion passes through the second connecting hole 1104. It should be noted that, in other embodiments of the present disclosure, the second rotating component 141 may also be an integral structure. A first groove 143 and a second groove 144 are defined on the cover plate 140, the first groove 143 is adjacent to the first rotating portion 1411, and the second groove 144 is adjacent to the second rotating portion 1412.

When the through hole 116 is covered by the cover plate 140, the pressing plate 130 is capable of driving the cover plate 140 to drive the first clipper body 111 to deform, so as to shorten or increase a distance between the second clipper head 122 and the first clipper head 112. Therefore, a gap 102 formed between the first clipper head 112 and the second clipper head 122 without the external force may be reduced or even closed.

When the through hole 116 is not covered by the cover plate 140, the cover plate 140 is located between the pressing plate 130 and the first clipper body 111, and a second end of the pressing plate 130 is capable of being attached to the first clipper body 111.

According to the embodiment of the present disclosure, when the through hole 116 is covered by the cover plate 140, the pressing plate 130 is capable of driving the cover plate 140 to drive the first clipper body 111 to deform, so as to shorten or increase a distance between the second clipper head 122 and the first clipper head 112 to achieve functions of trimming the fingernails or the toenails, and the fingernail clippings and the toenail clippings generated in actual application of the nail clipper may be accommodated in the accommodating cavity 115; when the through hole 116 is not covered by the cover plate 140, the cover plate 140 is located between the pressing plate 130 and the first clipper body 111, and the second end of the pressing plate 130 is capable of being attached to the first clipper body 111, that is, the pressing plate 130 is in a reset state, and the pressing plate 130 may not drive the first clipper body 111 to deform at this time. Removing the fingernail clippings or the toenail clippings accommodated in the accommodating cavity 115 may be achieved in a situation that the cover plate 140 is opened or the through hole 116 is not covered by the cover plate 140. Compared with providing a sliding sleeve to accommodate the fingernail clippings or the toenail clippings or remove the fingernail clippings or the toenail clippings in the prior art, the embodiments of the present disclosure provide the cover plate 140 to cover the through hole 116 or not cover the through hole 116 to accommodate the fingernail clippings or the toenail clippings or remove the fingernail clippings or the toenail clippings, which needs not to be sleeved with the main body in a sliding manner and needs not to be disassembled together with the main body, thereby reducing possibility of scratching the main body or even may not scratch the main body.

In addition, according to the embodiment of the present disclosure, when the cover plate 140 and the first clipper body 111 are driven by the pressing plate 130, the pressing plate 130 does not need to rotate by 180 degrees in the first direction to achieve function of trimming the fingernails and the toenails. Friction to a main body 101 is further reduced, and connection stability between the pressing plate 130 and the main body 101 is maintained. Moreover, a structure of the accommodating cavity 115 is formed between the first clipper body 111 and the second clipper body 121, compared with the accommodating space of the sliding sleeve in the prior art, the accommodating space of the sliding sleeve in the prior art is also occupied by the main body of the nail clipper, the embodiment of the present disclosure may increase a space for accommodating the clippings to a certain extent. In the actual application of the nail clipper, using the nail clipper once generally does not need to remove the clippings multiple times, which is convenient to operate.

As shown in FIG. 7, the pressing plate 130 includes a plate body 131 and a driving component 132, the driving component 132 is disposed on a surface of the plate body 131. When the through hole 116 is covered by the cover plate 140, the driving component 132 is capable of abutting against the cover plate 140, the plate body 131 is driven by an external force to drive the first clipper body 111 to deform through the driving component 132 and the cover plate 140, as so to shorten or increase the distance between the second clipper head 122 and the first clipper head 112. When the through hole 116 is not covered by the cover plate 140, at least a part of the driving component 132 is capable of being placed in the through hole 116, or the at least the part of the driving component 132 is capable of being placed in the through hole 116 and the accommodating cavity 115.

In one embodiment, one surface of the driving component 132 capable of abutting against the cover plate 140 is an arc-shaped surface 1321. The arc-shaped surface 1321 is beneficial for the driving component 132 to drive the cover plate 140.

In one embodiment, the plate body 131 includes a reinforcing structure 133, and the reinforcing structure 133 and the driving component 132 are located on two opposite surfaces of the plate body 131. The reinforcing structure 133 may enhance a strength of a position of the driving component 132 where the pressing plate 130 is located, and increase stability of the pressing plate 130.

As shown in FIG. 5, the through hole 116 includes a first through hole 1161 and a second through hole 1162, the first through hole 1161 is communicated with the second through hole 1162. Both the first through hole 1161 and the second through hole 1162 are communicated with the accommodating cavity 115. The first through hole 1161 is closer to the first clipper head 112 than the second through hole 1162, and the cover plate 140 is capable of covering the first through hole 1161 and the second through hole 1162. When the through hole 116 is not covered by the cover plate 140, the at least the part of the driving component 132 is capable of being placed in the first through hole 1161, or the at least the part of the driving component 132 is capable of being placed in the first through hole 1161 and the accommodating cavity 115.

An area of the first through hole 1161 is smaller than an area of the second through hole 1162. In one embodiment, a length of the first through hole 1161 in a width direction of the first clipper body 111 is smaller than a length of the second through hole 1162 in the width direction of the first clipper body 111.

In order to increase stability of the cover plate 140, in one embodiment, a reinforcing plate 142 is disposed at a periphery of the cover plate 140, when the through hole 116 is covered by the cover plate 140, the reinforcing plate 142 is disposed at one side or two sides of the first through hole 1161. In one embodiment, the reinforcing plate 142 is disposed at one side of the first through hole 1161, the reinforcing plate 142 includes a first reinforcing plate 1421 and a second reinforcing plate 1422. The first reinforcing plate 1421 protrudes from the first side of the first clipper body 111, and the second reinforcing plate 1422 protrudes from the second side of the first clipper body 111.

It should be noted that the main body 101 of the nail clipper 100 is not limited thereto. For example, the nail clipping includes the main body 101, the pressing plate 130, and a cover plate 140. The main body includes an accommodating cavity and a through hole, and the through hole is communicated with the accommodating cavity. A first end of the pressing plate is connected to the main body, and the pressing plate is capable of rotating with respect to the main body. The cover plate is connected to the main body, and the cover plate is capable of rotating with respect the main body so as to cover the through hole or not cover the through hole. When the through hole is covered by the cover plate, the pressing plate is capable of driving the cover plate to drive the main body, and when the through hole is not covered by the cover plate, the cover plate is located between the pressing plate and the main body, and a second end of the pressing plate is capable of being attached to the first clipper body. The pressing plate and the cover plate may refer to the pressing plate 130 and the cover plate 140, and details are not described herein again.

A structure of the main body 101 may refer to the first main body 110 and the second main body 120 as foregoing, and it should be understood that the structure of the main body 101 may also be other main body structures, such as a structure having one main body, a structure having three main bodies, or even a structure having more main bodies.

In order to prevent the clippings in the accommodation cavity of the embodiments of the present disclosure from being limited to the second end of the first clipper body and the second end of the second clipper body. In other embodiments of the nail clipper of the present disclosure, the nail clipper further includes a blocking component, the blocking component is disposed in the accommodating cavity, so as to prevent the clippings accommodated in the accommodating cavity from moving toward the second end of the first main body and the second end of the second main body. Since the second end of the first clipper body is fixedly connected to the second end of the second clipper body, if the clippings enter the second end of the first clipper body and the second end of the second clipper body, the clippings are hard to remove. Therefore, the embodiment of the present disclosure provides the blocking component in the accommodating cavity of the nail clipper, which may effectively block the clippings from entering the second end of the first clipper body and the second end of the second clipper body, and the embodiment of the present disclosure limits the clippings within a preset range, so as to facilitate removing. The following detailed description is made in conjunction with the drawings.

Figure 10:
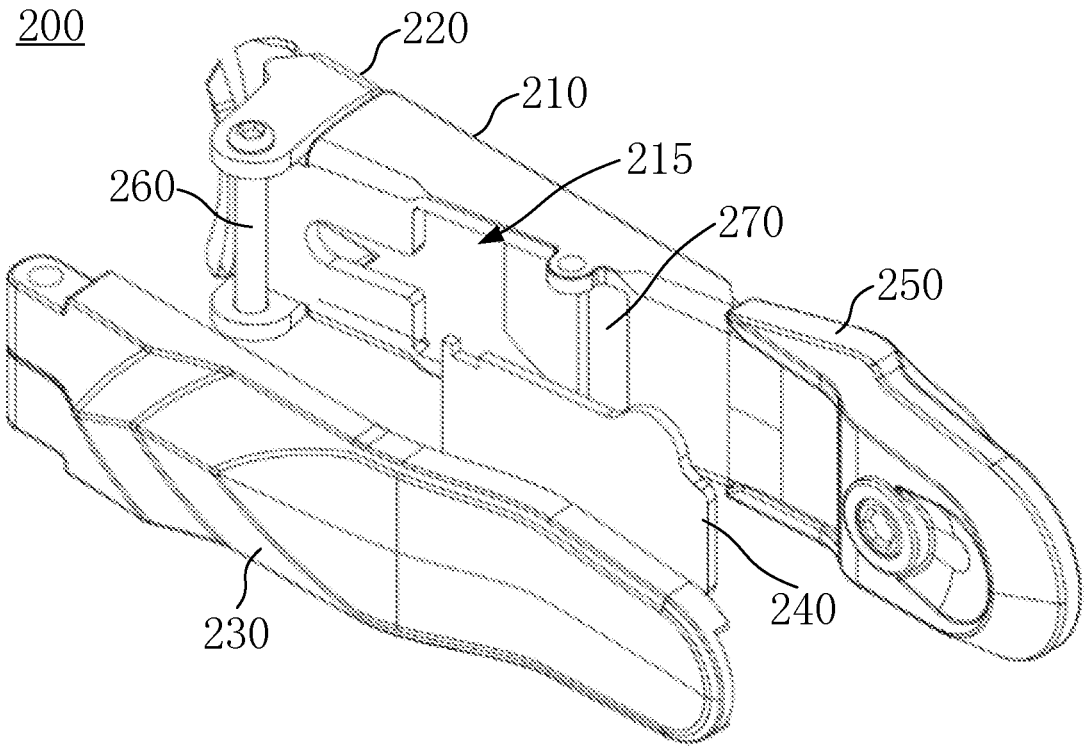
FIG. 10 is another exploded schematic diagram of the nail clipper according to one embodiment of the present disclosure.
Figure 11:
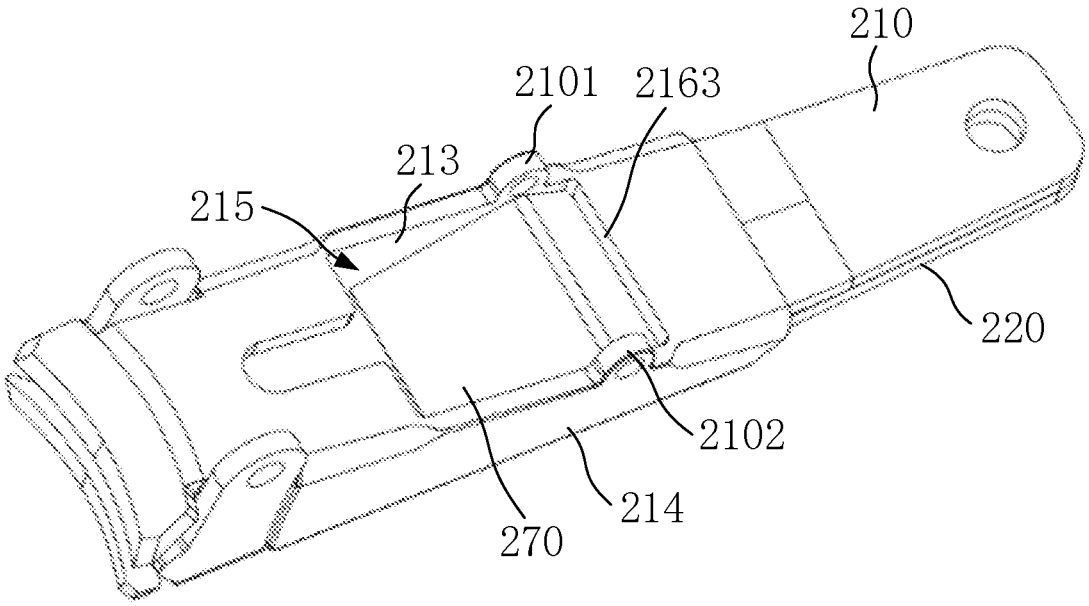
FIG. 11 is a structural schematic diagram of one part of the nail clipper according to one embodiment of the present disclosure.
Figure 12:
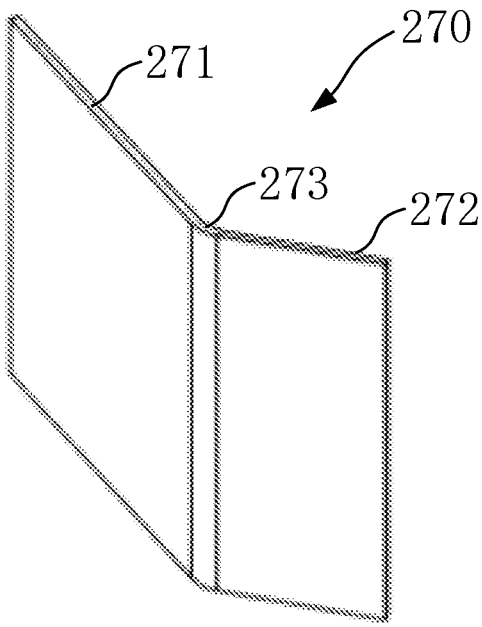
FIG. 12 is a structural schematic diagram of a blocking component of the nail clipper according to one embodiment of the present disclosure.

As shown in FIGS. 10-12, FIG. 10 is another exploded schematic diagram of the nail clipper according to one embodiment of the present disclosure, FIG. 11 is a structural schematic diagram of one part of the nail clipper according to one embodiment of the present disclosure, and FIG. 12 is a structural schematic diagram of a blocking component of the nail clipper according to one embodiment of the present disclosure. The nail clipper 200 may include a first main body 210, a second main body 220, a pressing plate 230, a cover plate 240, and a blocking component 270. The first main body 210, the second main body 220, the pressing plate 230, and the cover plate 240 may refer to FIGS. 19 and the first main body 110, the second main body 120, the pressing plate 130, and the cover plate 140 of the related content. Details are not described herein again.

The nail clipper 200 may further include a fastening assembly 250, the fastening assembly 250 may refer to FIGS. 1-9 and the fastening assembly 150 of the related content, details are not described herein again.

The nail clipper 200 may further include a first rotating component 260, the first rotating component 260 may refer to FIGS. 1-9 and the first rotating component 160 of the related content, details are not described herein again.

The first main body 210 includes a first clipper head, a first clipper body, a first baffle plate 213, and a second baffle plate 214. The first clipper head, the first clipper body, the first baffle plate 213, and the second baffle plate 214 may refer to the first clipper head 112, the first clipper body 111, the first baffle plate 113, and the second baffle plate 114. The first baffle plate 213 is disposed at a first side of the first clipper body, the second baffle plate 214 is disposed at a second side of the first clipper body, a through hole and an accommodating cavity 215 are defined on the first clipper body, and the through hole and the accommodating cavity 215 are located between the first baffle plate 213 and the second baffle plate 214. The blocking component 270 is disposed between the first baffle plate 213 and the second baffle plate 214, and the blocking component 270 is limited in the accommodating cavity 215.

The cover plate 240 is connected to the first clipper body through a second rotating component, the cover plate 240 is capable of rotating with respect to the first clipper body around the second rotating component, so as to cover the through hole or not cover the through hole. The second rotating component is disposed at two sides of the cover plate 240, the first clipper body includes a first protrusion block 2101 and a second protrusion block 2102, a first connecting hole is defined on the first protrusion block 2101, a second connecting hole is defined on the second protrusion block 2102, and the second rotating component passes through the first connecting hole and the second connecting hole. It should be noted that the first protrusion block 2101 and the first baffle plate 213 are located at the same side of the first clipper body, and the second protrusion block 2102 and the second baffle plate 214 are located at the same side of the first clipper body. The second rotating shaft may refer to the second rotating shaft 141. The first protrusion block 2101, the second protrusion block 2102, the first connecting hole, and the second connecting hole may refer to the first protrusion block 1101, the second protrusion block 1102, the first connecting hole 1103, and the second connecting hole 1104, and details are not described herein again.

The blocking component 270 includes a blocking portion 271, a connecting portion 273, and a limiting portion 272. The blocking portion 271, the connecting portion 273, and the limiting portion 272 are all disposed in the accommodating cavity 215 and are limited by the first baffle plate 213, the second baffle plate 214, the second main body, and the cover plate 240. A first end of the blocking portion 271 is connected to a first end of the limiting portion 272 through the connecting portion 273. The blocking portion 271, the connecting portion 273, and the limiting portion 272 may be integrally formed, for example, being formed by metal sheets. The blocking portion 271 and the limiting portion 272 are bent with respect to the connecting portion 273, a second end of the blocking portion 271 is capable of abutting against the second clipper body of the second main body, and is obliquely disposed with respect to the second clipper body. The second end of the limiting portion 272 is capable of abutting against the second clipper body of the second main body, and is obliquely disposed with respect to the second clipper body. The limiting portion 272 is disposed close to one edge, such as a first edge 2163, of the through hole, and the first edge 2163 of the through hole is away from the first clipper head of the first main body, which may be understood as being close to the second end of the first main body and the second end of the second main body. When the limiting portion 272 is subjected to an extrusion force, a surface of the limiting portion is capable of abutting against the first edge 2163 to limit the connecting portion 273 and the blocking portion 271 to limit excessive movement of the connecting portion 273 and the blocking portion 271 toward the second end of the first main body and the second end of the second main body. The limiting portion 272 may limit the connection portion 273 below the first protrusion block 2101 and the second protrusion block 2102.

An inclination of the blocking portion 271 with respect to the second clipper body is less than an inclination of the limiting portion 272 with respect to the second clipper body. It can be understood that, compared with the blocking portion 271, the limiting portion 272 is more obliquely disposed with respect to the second clipper body. Therefore, a cooperation relationship of the blocking portion 271, the connecting portion 273, and the limiting portion 272 of the embodiments of the present disclosure may limit the clippings in the accommodating cavity 215, so as to prevent the clippings from moving toward the second end of the first main body and the second end of the second main body, thereby facilitating removing the clippings.

The nail clipper provided by the embodiments of the present disclosure is described in detail, and specific examples are used herein to describe the principles and embodiments of the present disclosure, and the above method and the core idea thereof; at the same time, for those who skilled in the art, according to the idea of the present disclosure, in a specific implementation manner and an application range, the content should be changed. In summary, the content of the present specification should not be construed as a limitation to the present disclosure.

What is claimed is:

1. A nail clipper, comprising:

a first main body;

a second main body;

a pressing plate; and a cover plate;

wherein the first main body comprises a first clipper head, a first clipper body, a first baffle plate, and a second baffle plate; the first clipper head is fixedly connected to a first end of the first clipper body, the first baffle plate is disposed at a first side of the first clipper body, the second baffle plate is disposed at a second side of the first clipper body; a through hole is defined on the first clipper body, and the through hole is located between the first baffle plate and the second baffle plate;

the second main body comprises a second clipper head and a second clipper body, the second clipper head is fixedly connected to a first end of the second clipper body, a second end of the second clipper body is fixedly connected to a second end of the first clipper body; the second clipper head is disposed opposite to the first clipper head; the first baffle plate, the second baffle plate, the first clipper body, and the second clipper body form an accommodating cavity;

a first end of the pressing plate is connected to the first end of the second clipper body through a first rotating component, the pressing plate is capable of rotating with respect to the second clipper body around the first rotating component;

the cover plate is connected to the first clipper body through a second rotating component, the cover plate is capable of rotating with respect to the first clipper body around the second rotating component, so as to cover the through hole or not cover the through hole;

when the through hole is covered by the cover plate, the pressing plate is capable of driving the cover plate to drive the first clipper body to deform, so as to shorten or increase a distance between the second clipper head and the first clipper head;

when the through hole is not covered by the cover plate, the cover plate is located between the pressing plate and the first clipper body, and a second end of the pressing plate is capable of being in contact with the first clipper body;

the pressing plate comprises a plate body and a driving component, the driving component is disposed on a surface of the plate body;

when the through hole is covered by the cover plate, the driving component is capable of abutting against the cover plate, the plate body is driven by an external force to drive the first clipper body to deform through the driving component and the cover plate, as so to shorten or increase the distance between the second clipper head and the first clipper head;

when the through hole is not covered by the cover plate, at least a part of the driving component is capable of being placed in the through hole, or the at least the part of the driving component is capable of being placed in the through hole and the accommodating cavity; and the plate body comprises a reinforcing structure, and the reinforcing structure and the driving component are located on two opposite surfaces of the plate body.

2. The nail clipper according to claim 1, wherein the through hole comprises a first through hole and a second through hole, the first through hole is communicated with the second through hole; both the first through hole and the second through hole are communicated with the accommodating cavity; the first through hole is closer to the first clipper head than the second through hole, and the cover plate is capable of covering the first through hole and the second through hole; and when the through hole is not covered by the cover plate, the at least the part of the driving component is capable of being placed in the first through hole, or the at least the part of the driving component is capable of being placed in the first through hole and the accommodating cavity.

3. The nail clipper according to claim 2, wherein an area of the first through hole is smaller than an area of the second through hole.

4. The nail clipper according to claim 3, wherein a length of the first through hole in a width direction of the first clipper body is smaller than a length of the second through hole in the width direction of the first clipper body.

5. The nail clipper according to claim 2, wherein a reinforcing plate is disposed at a periphery of the cover plate, when the through hole is covered by the cover plate, the reinforcing plate is disposed at one side or two sides of the first through hole.

6. The nail clipper according to claim 5, wherein the reinforcing plate comprises a first reinforcing plate and a second reinforcing plate; the first reinforcing plate protrudes from the first side of the first clipper body, and the second reinforcing plate protrudes from the second side of the first clipper body.

7. The nail clipper according to claim 1, wherein one surface of the driving component capable of abutting against the cover plate is an arc-shaped surface.

8. The nail clipper according to claim 1, wherein the second rotating component is disposed at two sides of the cover plate, the first clipper body comprises a first protrusion block and a second protrusion block, a first connecting hole is defined on the first protrusion block, a second connecting hole is defined on the second protrusion block, and the second rotating component passes through the first connecting hole and the second connecting hole.

9. The nail clipper according to claim 1, wherein the second main body further comprises a first connecting component and a second connecting component; the first connecting component is disposed at a first side of the second clipper body, the second connecting component is disposed at a second side of the second clipper body, and the first connecting component and the second connecting component are oppositely disposed at the first end of the second clipper body;

the first connecting component and the second connecting component are jointly connected to the first end of the pressing plate through the first rotating component; and the first clipper body is capable of being located between the second clipper body and the pressing plate, and a part of the first clipper body is limited between the second clipper body, the first connecting component, the second connecting component, and the pressing plate.

10. The nail clipper according to claim 9, wherein a first shaft hole is defined on the first connecting component, a second shaft hole is defined on the second connecting component; and a third shaft hole is defined at the first end of the pressing plate, the first rotating component passes through the first shaft hole, the third shaft hole, and the second shaft hole.

11. The nail clipper according to claim 9, wherein a first notch is formed between the first baffle plate and the first clipper head, and a second notch is formed between the second baffle plate and the first clipper head;

the first notch accommodates the first connecting component, and the first connecting component is capable of moving in the first notch; and the second notch accommodates the second connecting component, and the second connecting component is capable of moving in the second notch.

12. The nail clipper according to claim 1, wherein the nail clipper further comprises a fastening assembly, the fastening assembly is fixedly connected to the second end of the first clipper body and the second end of the second clipper body.

13. The nail clipper according to claim 12, wherein the fastener assembly comprises a fastening plate and a fastener; a first fastening hole is defined on the first clipper body, a second fastening hole is defined on the second clipper body, and a third fastening hole is defined on the fastening plate; the fastener passes through the first fastening hole, the second fastening hole, and the third fastening hole.

14. The nail clipper according to claim 13, wherein an accommodating groove is defined on the fastening plate, both the second end of the first clipper body and the second end of the second clipper body are disposed in the accommodating groove, and the accommodating groove is respectively communicated with the first fastening hole and the second fastening hole.

15. The nail clipper according to claim 1, wherein the nail clipper further comprises a blocking component, the blocking component is disposed between the first baffle plate and the second baffle plate, and is limited in the accommodating cavity, so as to prevent clippings accommodated in the accommodating cavity from moving toward the second end of the first main body and the second end of the second main body.

16. The nail clipper according to claim 15, wherein the blocking component comprises a blocking portion, a connecting portion, and a limiting portion; the blocking portion, the connecting portion, and the limiting portion are all disposed in the accommodating cavity and are limited by the first baffle plate, the second baffle plate, the second main body, and the cover plate;

a first end of the blocking portion is connected to a first end of the limiting portion through the connecting portion; the blocking portion and the limiting portion are bent with respect to the connecting portion, a second end of the blocking portion is capable of abutting against the second clipper body, and is obliquely disposed with respect to the second clipper body; a second end of the limiting portion is capable of abutting against the second clipper body, and is obliquely disposed with respect to the second clipper body; the limiting portion is disposed close to a first edge of the through hole, and the first edge of the through hole is away from the first clipper head; and when the limiting portion is subjected to an extrusion force, a surface of the limiting portion is capable of abutting against the first edge of the through hole to limit the connecting portion and the blocking portion to limit excessive movement of the connecting portion and the blocking portion toward the second end of the first main body and the second end of the second main body.

17. A nail clipper, comprising:

a main body;

a pressing plate; and a cover plate;

wherein the main body comprises an accommodating cavity and a through hole, and the through hole is communicated with the accommodating cavity; a first end of the pressing plate is connected to the main body, and the pressing plate is capable of rotating with respect to the main body; the cover plate is connected to the main body, and the cover plate is capable of rotating with respect to the main body, so as to cover the through hole or not cover the through hole;

when the through hole is covered by the cover plate, the pressing plate is capable of driving the cover plate to drive the main body; and when the through hole is not covered by the cover plate, the cover plate is located between the pressing plate and the main body, and a second end of the pressing plate is capable of being in contact with a first clipper body of the main body;

the pressing plate comprises a plate body and a driving component, the driving component is disposed on a surface of the plate body;

when the through hole is covered by the cover plate, the driving component is capable of abutting against the cover plate, the plate body is driven by an external force to drive the main body through the driving component and the cover plate;

when the through hole is not covered by the cover plate, at least a part of the driving component is capable of being placed in the through hole, or the at least the part of the driving component is capable of being placed in the through hole and the accommodating cavity;

the through hole comprises a first through hole and a second through hole, the first through hole is communicated with the second through hole; both the first through hole and the second through hole are communicated with the accommodating cavity; the first through hole is closer to a clipper head of the main body than the second through hole, and the cover plate is capable of covering the first through hole and the second through hole;

when the through hole is not covered by the cover plate, the at least the part of the driving component is capable of being placed in the first through hole, or the at least the part of the driving component is capable of being placed in the first through hole and the accommodating cavity;

a length of the first through hole in a width direction of the first clipper body is smaller than a length of the second through hole in the width direction of the first clipper body;

a reinforcing plate is disposed at a periphery of the cover plate, when the through hole is covered by the cover plate, the reinforcing plate is disposed at one side or two sides of the first through hole; and one surface of the driving component capable of abutting against the cover plate is an arc-shaped surface, the plate body comprises a reinforcing structure, and the reinforcing structure and the driving component are located on two opposite surfaces of the plate body.

* * * * *